United States Patent [19]

Mutschler

[11] 4,239,408

[45] Dec. 16, 1980

[54] FOUNTAIN PEN WITH IMPROVED INK FLOW CONTROL

[76] Inventor: Otto Mutschler, Ludolf-Krehl-Str. 21, D-6900 Heidelberg, Fed. Rep. of Germany

[21] Appl. No.: 10,730

[22] Filed: Feb. 9, 1979

[30] Foreign Application Priority Data

Mar. 2, 1978 [DE] Fed. Rep. of Germany ..... 2808910

[51] Int. Cl.[3] ..... B43K 7/02

[52] U.S. Cl. ..... 401/217

[58] Field of Search ..... 401/217, 223, 224, 230, 401/258, 259, 260, 198

[56] References Cited

U.S. PATENT DOCUMENTS

| | | | |
|---|---|---|---|
| 2,504,649 | 4/1950 | Chesler | 401/217 |
| 2,648,309 | 8/1953 | Bartell | 401/223 |
| 2,684,052 | 7/1954 | Rickmeyer | 401/223 X |
| 2,782,763 | 2/1957 | Zodtner | 401/223 |
| 2,911,949 | 11/1959 | Beckwith | 401/217 X |
| 2,983,254 | 5/1961 | Silver | 401/223 |
| 3,129,696 | 4/1964 | Makler | 401/217 |

*Primary Examiner*—John D. Yasko

*Attorney, Agent, or Firm*—Toren, McGeady and Stanger

[57] ABSTRACT

The ink supply system of a fountain pen which defines a longitudinal path of ink flow from a reservoir in the pen barrel to a writing point projecting from the barrel includes an ink feeding member defining therein one portion of the ink path contiguously adjacent the writing point and a flow controlling member defining another portion of the path which connects the ink feeding member to the reservoir. The latter portion of the ink path is elongated and has an effective flow section smaller than the flow section in the feeding member.

8 Claims, 2 Drawing Figures

FOUNTAIN PEN WITH IMPROVED INK FLOW CONTROL

This invention relates to fountain pens, and particularly to a fountain pen with improved control of ink flow from an ink reservoir to the writing point of the pen.

It is a well known problem in fountain pens that the flow of ink from an ink reservoir to the writing point is affected by many factors not directly related to the construction of the pen and not capable of being controlled by the user such as changes in ambient temperature and pressure.

Many ingenious devices have been proposed and are being utilized in fountain pens for alleviating ink spillage and other malfunctioning of fountain pens under unfavorable environmental conditions, but the problem is still far from being solved satisfactorily.

It is a primary object of this invention to provide a fountain pen in which the flow of ink from a reservoir to a writing point is controlled more effectively than was possible heretofore, particularly under conditions of varying ambient temperature and pressure.

The invention, in one of its more specific aspects, provides a fountain pen with a longitudinal path of ink flow in the pen barrel or housing which path is defined contiguously adjacent the writing point by an ink feeding member while a flow controlling member defines another portion of the path connecting the ink feeding member to the reservoir. The last-mentioned path portion is elongated and has an effective flow section smaller than the effective flow section of the first-mentioned portion.

Figure 1:
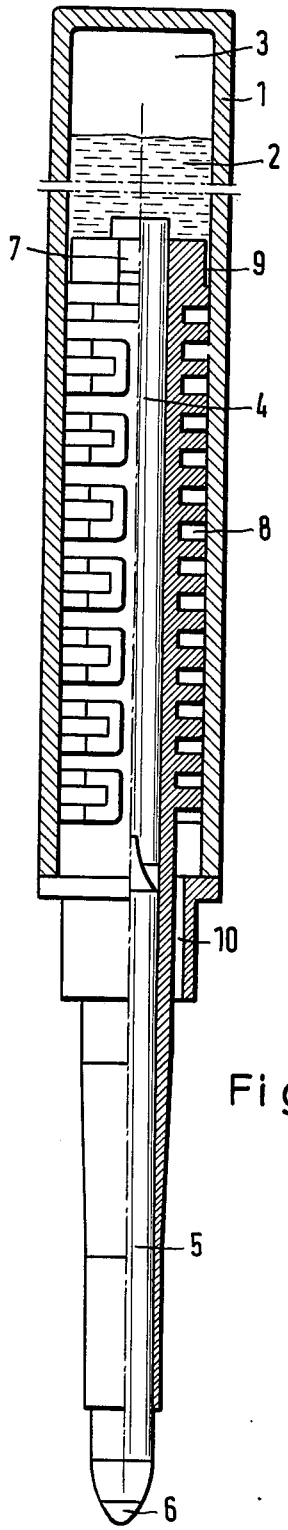
Figure 2:
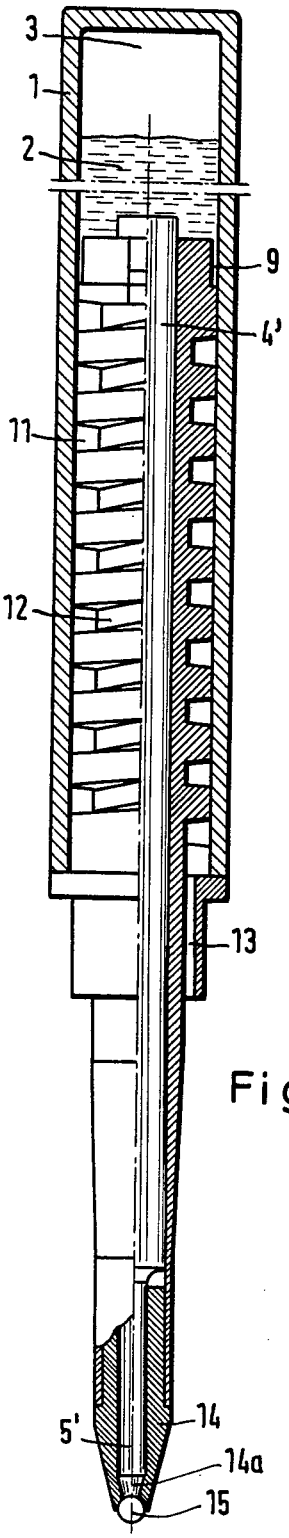

Other features, additional objects, and many of the attendant advantages of this invention will readily be appreciated as the same becomes better understood from the following detailed description of preferred embodiments when considered in connection with the appended drawing in which:

FIG. 1 shows a fountain pen of the invention in section on the longitudinal axis of its barrel or housing, the feed bar in the barrel being partly shown in the same section, and partly in elevation; and FIG. 2 illustrates another fountain pen of the invention in a view corresponding to that of FIG. 1.

Referring initially to FIG. 1, there is seen a generally cylindrical barrel or housing 1 closed at its rear end to define a reservoir partly filled with ink 2 and partly with air 3. Ink flows normally from the reservoir through an elongated flow control element 4 consisting of a tightly compressed rod of felt. Rabbit hair is a preferred felt material for this application, but it may also consist of other natural or synthetic fibers, and rods of sintered metal and sintered ceramics defining longitudinal channels of capillary dimensions have been employed successfully.

The front end of the felt rod is engaged by the pointed rear end of a plastic wick 5 consisting of homopolymer acetal resin whose front end 6 is tapered to constitute the writing point of the pen which projects longitudinally from the barrel 1. The felt rod 4 and the wick 5 are enclosed over most of their respective lengths in the axial bore of a tubular feed bar 7. As is conventional in itself, a labyrinth groove 8 in the outer longitudinal surface of the feed bar 7 and a capillary gap 9 between the rear end of the feed bar and the inner wall of the barrel 1 permit air to enter the reservoir at the rear end of the barrel from an axially open orifice 10 between the front end of the barrel 1 and the feed bar 7.

During normal writing action, ink is drawn from the reservoir into the passages of the felt rod 4 by capillary action and is taken from the front end of the rod 4 by the plastic wick 5 whose effective flow section is greater than that of the rod 4. When the temperature in the pen rises, the air body 3 in the reservoir expands and drives ink through the gap 9 into the labyrinth groove 8 of the feed bar 7. However, the increased air pressure cannot overcome the flow resistance of the capillary ducts in the felt rod 4, and no ink flows out of the point 6 unless the point is in contact with a writing surface.

The pen illustrated in FIG. 2 has a barrel 1 not significantly different from that shown in FIG. 1 and defines a reservoir partly filled with ink 2 and air 3. A flow control rod 4' of felt extends from the reservoir almost through the entire length of a tubular feed bar 12 and out of the barrel. A tubular ball receptacle 14 is retained by a friction fit in the front end of the feed bar 12 and holds a partly exposed spherical writing point 15. A wick 5' of acetal resin formed with capillary passages is received in the bore of the receptacle 14 and longitudinally abuts against the front end of the rod 4' to deliver ink to the rolling writing point 15 through capillary passages in a partition **14*a* in the receptacle 14. Air may enter the reservoir in the barrel 1 from an orifice 13 between the feed bar 12, a spiral groove 11 in the outer longitudinal surface of the feed bar, and a capillary gap 9 between the feed bar 12** and the inner barrel surface.

The material of the flow control rod 4, 4' is readily chosen to match the viscosity and capillary properties of the ink to be employed. Bundled fibers of synthetic fibers, such as polyamides, acrylic resins, and polyesters, have been used but may differ in their respective capillarities relative to the same ink, and some experimentation may be necessary to match the best rod material to a specific ink. Felt of animal hair is usually less selective.

In both illustrated embodiments of the invention, the rear end of the flow control rod 4, 4' makes direct contact with the body 2 of ink in the barrel reservoir, and this arrangement is preferred because of its simplicity, but not critical. Ducts bounded by the barrel, the feed bar, or both may connect the rear end of the flow control rod to the ink body in the barrel reservoir.

It should be understood, therefore, that the foregoing disclosure relates only to preferred embodiments of the invention, and that it is intended to cover all changes and modifications of the examples of the invention herein chosen for the purpose of the invention which do not constitute departures from the spirit and scope of the invention set forth in the appended claims.

What is claimed is:

1. In a fountain pen comprising an elongated housing having first end and a second end spaced apart in the elongated direction, the first end of said housing being open and the second end being closed, an elongated feed bar located within said housing and extending into the open first end of said housing toward the second end thereof, said feed bar having a first end and a second end spaced apart in the elongated direction thereof, the first end of said feed bar spaced outwardly from the first end of said housing and the second end of said feed bar located within said housing and spaced from the first and second ends of said housing, the interior of said housing forming an ink reservoir between the second end of said housing and the second end of said feed bar, a writing point projecting outwardly from the first end of said feed bar in the direction away from said housing, means for supplying ink from said ink reservoir to said writing point, at least said first feed bar forming a first passageway for admitting atmospheric air into the ink reservoir for replacing the ink supply from said ink reservoir to said writing point, wherein the improvement comprises that said means for supplying ink comprises an ink feeding member in communication with said writing point, and an elongated flow controlling member extending through said feed bar in the elongated direction thereof and connecting said ink feeding member and said ink reservoir, said ink feeding member having an effective flow cross section therethrough transversely of the elongated direction of said feed far and said flow controlling member having an effective flow section therethrough transverse of the elongated direction of said feed bar with the effective flow section of said flow controlling member being smaller than the effective flow section of said ink feeding member.

2. In a fountain pen, as set forth in claim 1, wherein said flow controlling member comprising a plurality of capillary passages for flowing ink therethrough from said ink reservoir to said ink feeding member.

3. In a fountain pen, as set forth in claim 1, wherein said flow controlling member being formed of a rod of fibrous material forming said capillary passages.

4. In a fountain pen, as set forth in claim 3, wherein said rod of fibrous material comprises a rod of felt.

5. In a fountain pen, as set forth in claim 4, wherein said ink feeding member comprises a plastic wick consisting of homopolymer acetal resin with the end of said wick spaced from said flow controlling member tapering inwardly for forming said writing point.

6. In a fountain pen, as set forth in claim 1, wherein said feed bar having a bore extending therethrough in the elongated direction thereof, at least a part of said flow controlling member extending in the elongated direction thereof being located within said bore, and the outer surface of said feed bar having a recess therein extending between the first end of said housing and said ink reservoir with said recess and the inner surface of said housing forming the first passageway connecting said ink reservoir with the ambient atmosphere.

7. In a fountain pen, as set forth in claim 1, wherein said flow controlling member having a greater resistance to the flow of ink therethrough from said ink reservoir than the resistance to the flow of ink through said ink feeding member.

8. In a fountain pen, as set forth in claim 1, wherein said flow controlling member having the end thereof closer to the second end of said housing located within said ink reservoir.

* * * * *